US006629895B2

(12) United States Patent
Uemura et al.

(10) Patent No.: US 6,629,895 B2
(45) Date of Patent: Oct. 7, 2003

(54) AMUSEMENT RIDE SYSTEM

(75) Inventors: Hiroshi Uemura, Tokyo (JP); Teruo Matsumoto, Chiba-ken (JP)

(73) Assignee: Sega Corporation, Tokyo (JP)

( * ) Notice: Subject to any disclaimer, the term of this patent is extended or adjusted under 35 U.S.C. 154(b) by 0 days.

(21) Appl. No.: 09/987,161

(22) Filed: Nov. 13, 2001

(65) Prior Publication Data

US 2002/0068640 A1 Jun. 6, 2002

(30) Foreign Application Priority Data

Dec. 1, 2000 (JP) ..... 2000-367776

(51) Int. Cl.[7] ..... A63G 31/16
(52) U.S. Cl. ..... 472/60; 472/2; 472/131
(58) Field of Search ..... 472/2, 59, 60, 472/131, 49, 50; 187/401, 414

(56) References Cited

U.S. PATENT DOCUMENTS 5,597,358 A * 1/1997 Marcu ..... 434/29
5,964,666 A * 10/1999 Uemura ..... 472/2
6,076,638 A * 6/2000 Gertz ..... 187/414
6,083,111 A * 7/2000 Moser et al. ..... 472/131

FOREIGN PATENT DOCUMENTS

JP 10-15249 1/1998

* cited by examiner

*Primary Examiner*—Kien T. Nguyen
(74) *Attorney, Agent, or Firm*—Dickstein Shapiro Morin & Oshinsky LLP

(57) ABSTRACT

An amusement ride system having an amusement ride for carrying a rider thereon while giving the rider a high-speed view of a screen provided along a traveling path of the amusement ride extending vertically, for example. A plurality of image projectors for projecting an image toward the screen are positioned in one side of the traveling path opposite from the screen and configured to project an image in a direction transverse to a line of vision of the rider thereby to give the rider vivid representation of the image improved in the feeling of presence of the rider.

14 Claims, 15 Drawing Sheets

AMUSEMENT RIDE SYSTEM

BACKGROUND OF THE INVENTION

1. Field of the Invention

This invention relates to an amusement ride system giving riders of an amusement ride a good view of a screen provided along the movement path of the amusement ride.

2. Description of the Related Art

An amusement ride system having riders of its amusement ride to get a thrill of falling by driving down the amusement ride has already been proposed (Japanese Patent Laid-Open Publication No. 10-15249). In this amusement ride system, a display means is provided to extend along the up and down moving directions of the amusement ride in front of the seats accommodating riders so that the images and light displayed on the display means can move up and down in response to up and down movements of the amusement ride.

This known amusement ride system, however, uses CFRT as the display means for representation of images, which cannot represent large images. Therefore, it has been difficult to display distant landscapes with realty. In addition, the system needs a large number of display means and is inevitably high in cost.

It is therefore an object of the invention to provide an amusement ride system overcoming the above-mentioned problems, namely, capable of representing large images, thereby displaying distant landscapes, and reducing the cost because of not requiring a large number of display means.

SUMMARY OF THE INVENTION

According to the invention, there is provided an amusement ride system including an amusement ride for a rider to ride, and a drive device for moving the amusement ride along a traveling path, comprising:

a display screen provided to extend along the traveling path; and an image projector for projecting an image toward the display screen, the image projector extending along one side of said traveling path opposite from the display screen, the amusement ride being adapted to orient the line of vision of the rider on the amusement ride in a direction transverse to the image projecting direction of the image projector.

With the amusement ride system having the above-summarized configuration, even when the display screen extending along the traveling path of the amusement ride has a wide display area in accordance with a long extension of the traveling path, the image projector can display a continuous image without interruption over a relatively wide area of the display screen, thereby to give a vivid representation of the image.

The configuration of the amusement ride that orients the line of vision of the rider transverse to the image projecting direction of the image projector ensures offsetting the line of vision of the rider from a part of the screen containing a shade of the amusement ride made by interference of the projected light from the image projector by the amusement ride to always give the rider vivid representation of the image with no shade.

The amusement ride system may further comprise a floor, a floor display screen extending along said floor, and an image projector for projecting an image onto the floor display screen, thereby to give the rider a feeling of sky swimming more effectively.

When the traveling path extends vertically and the amusement ride is adapted to orient the line of vision of the rider to bow forwardly aslant, it is possible to give the rider on the amusement ride a highly vivid sense of falling in the sky.

The seat for the rider to sit on can preferably bow aslant forwardly of the rider while the amusement travels up and down, such that the rider is most likely to take a posture orienting the line of vision thereof onto a part of the display screen representing an image of ground sceneries.

An embracing means is preferably provided to embrace the rider on the seat while the amusement ride travels up and down, thereby to hold the rider in a stable posture sitting on the seat and thereby preserve the rider safe even when orienting the line of vision of the rider on the seat by a large angle with respect to a horizontal plane.

When the amusement ride is partly cut out to be opened over an area forward and downwardly aslant forward of the seat, it is possible to give the rider a sense of actually falling in the sky and give a taste of thrill.

When the traveling path may be horizontal with or without vertical undulation, the amusement ride is preferably adapted to orient the line of vision of the rider thereon toward a region of said display screen distant in the traveling direction from a region thereof normal to the current position of the amusement ride. In this case, a clear image of outdoor sceneries can be given to the rider on the amusement ride traveling along the ground plane over a wide traveling range of the amusement ride with a few image projecting means.

The amusement ride preferably has a seat for the ride to sit on, and the seat preferably faces forwardly aslant from the traveling direction of the amusement ride. Thus the rider can easily watch the image representing the landscape along the traveling path without twisting the head.

The image projected on the display screen preferably contains a moving object that moves in the opposite direction from the traveling direction of the amusement ride. In this case, the rider on the amusement ride will feel a traveling speed faster than the actual traveling speed of the amusement ride because the object in the image flys in the opposite direction. Therefore, even in a relatively narrow space, the rider can feel as moving in a wider space at a high speed.

Then the amusement ride has a seat for a rider to sit on, and a blower means is provided to blow a wind from under the seat toward the rider on the seat, it is possible to directing a strong blow of the wind caused by the travel toward the face and clothes of the rider on the amusement ride, thereby to remarkable increase the sense of speed.

According to the invention, there is also provided an amusement ride system having a seat for a rider to sit on, comprising: a display screen for representation of an image thereon; an image display device for displaying the image on the display screen; a drive device for moving the seat; and a means for controlling the image display device to display the image on the display screen in response to activation of the drive device. Thus the image projected on the display screen can be changed synchronously with the travel of the amusement ride.

The image display device may include an image control device for controlling the image synchronously with the travel of the seat, and an image producing means for generating the image in response to a signal from the image control device, thereby to enable easy and adequate generation of an image to be displayed on the display screen.

According to the invention, there is further provided an amusement ride system having a seat for a rider to sit on, comprising; a display screen for representation of an image thereon; an image display device for displaying said image on said display screen; a seat drive device for moving said seat; and a drive control device for controlling said seat drive device in response to activation of said image display device such that said seat drive device moves said seat in response to a condition of representation of the image on said display screen by said image display device. Thus the seat can be driven in accordance with the image displayed on the display screen to orient the rider on the seat onto the image on the display screen.

A traveling path and an amusement ride traveling on the traveling path may be provided in an interior space of the amusement ride, and the seat may be borne on the amusement ride, thereby to enable quick and precise change of orientation of the seat on the amusement ride traveling along the traveling path.

DESCRIPTION OF THE PREFERRED EMBODIMENTS

Figure 2:
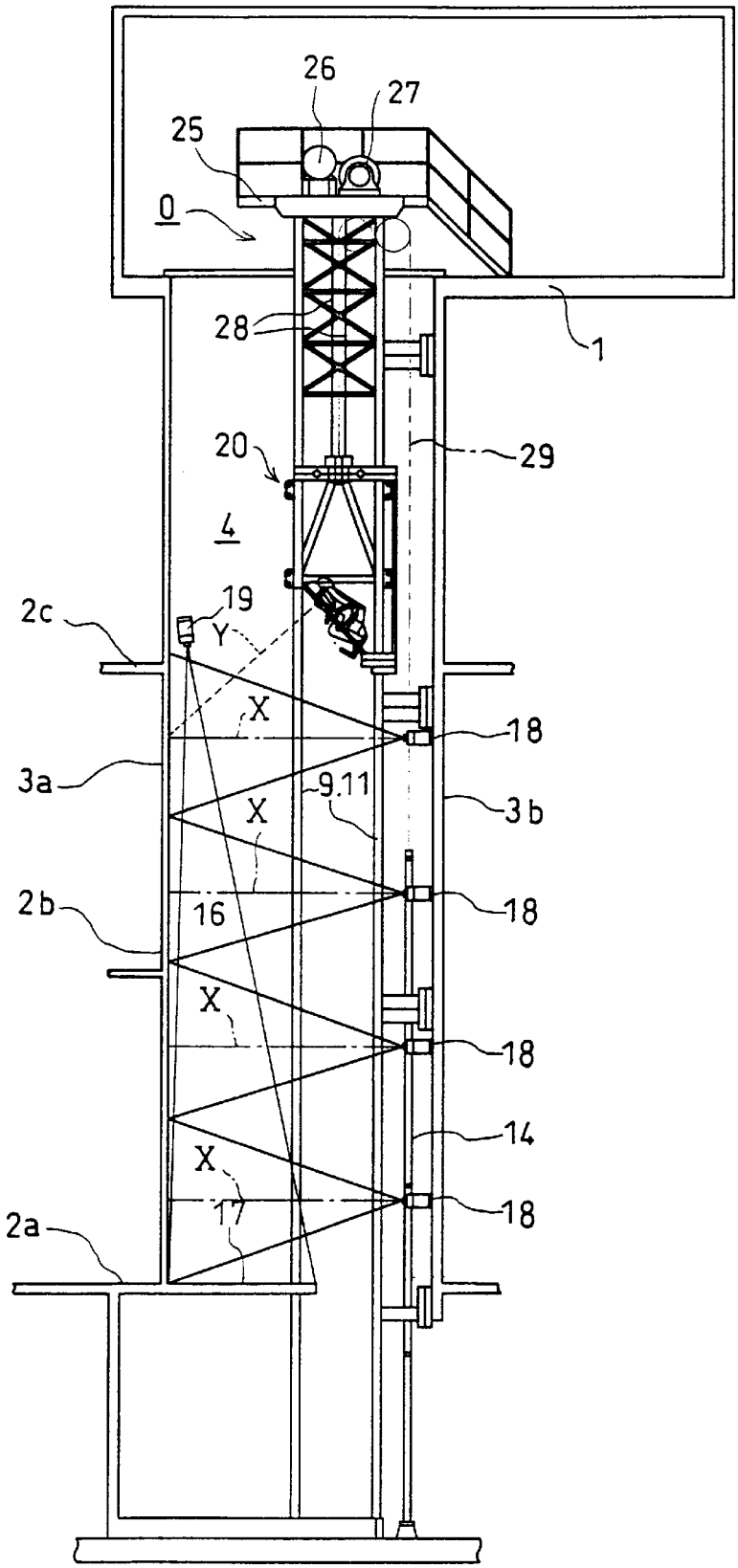
FIG. 2 is a left side-elevational view of FIG. 1.
Figure 3:
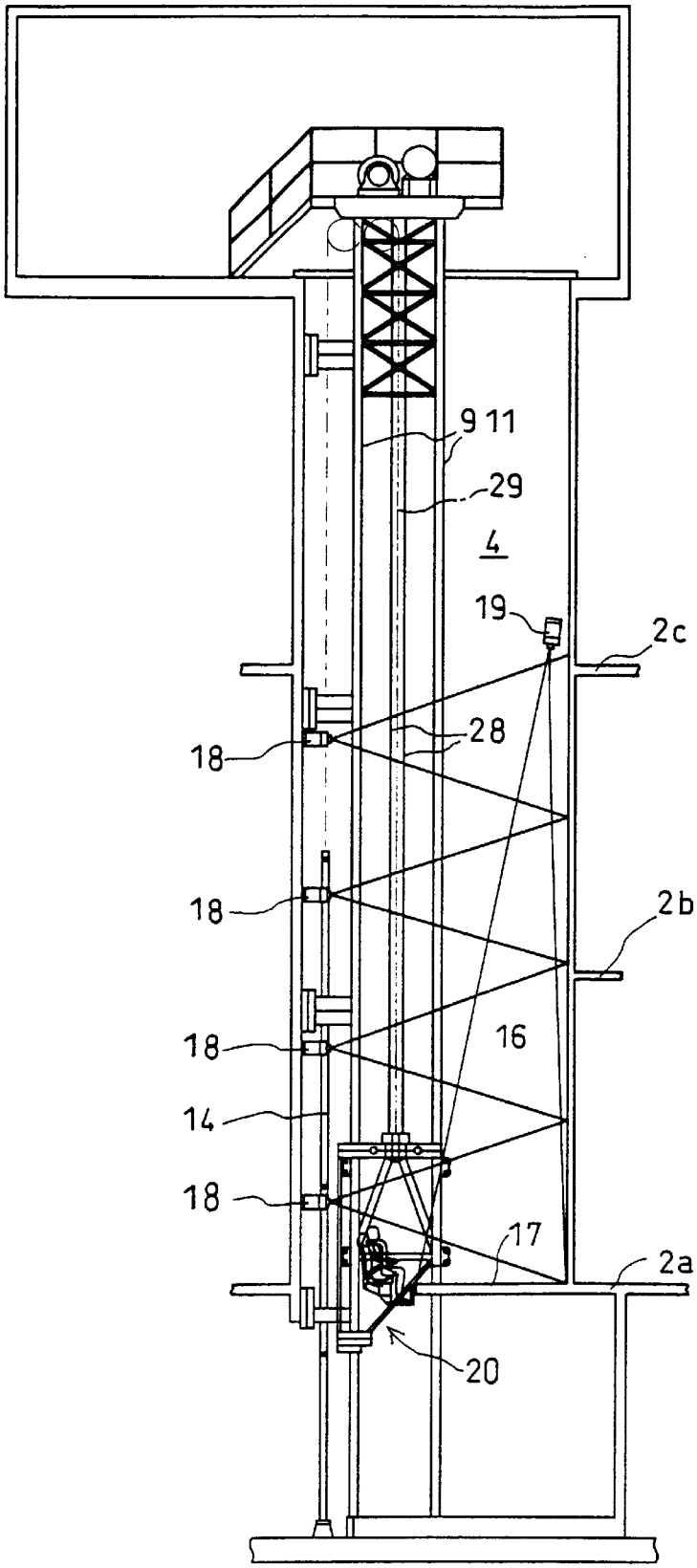
FIG. 3 is a right side-elevational view of FIG. 1.
Figure 4:
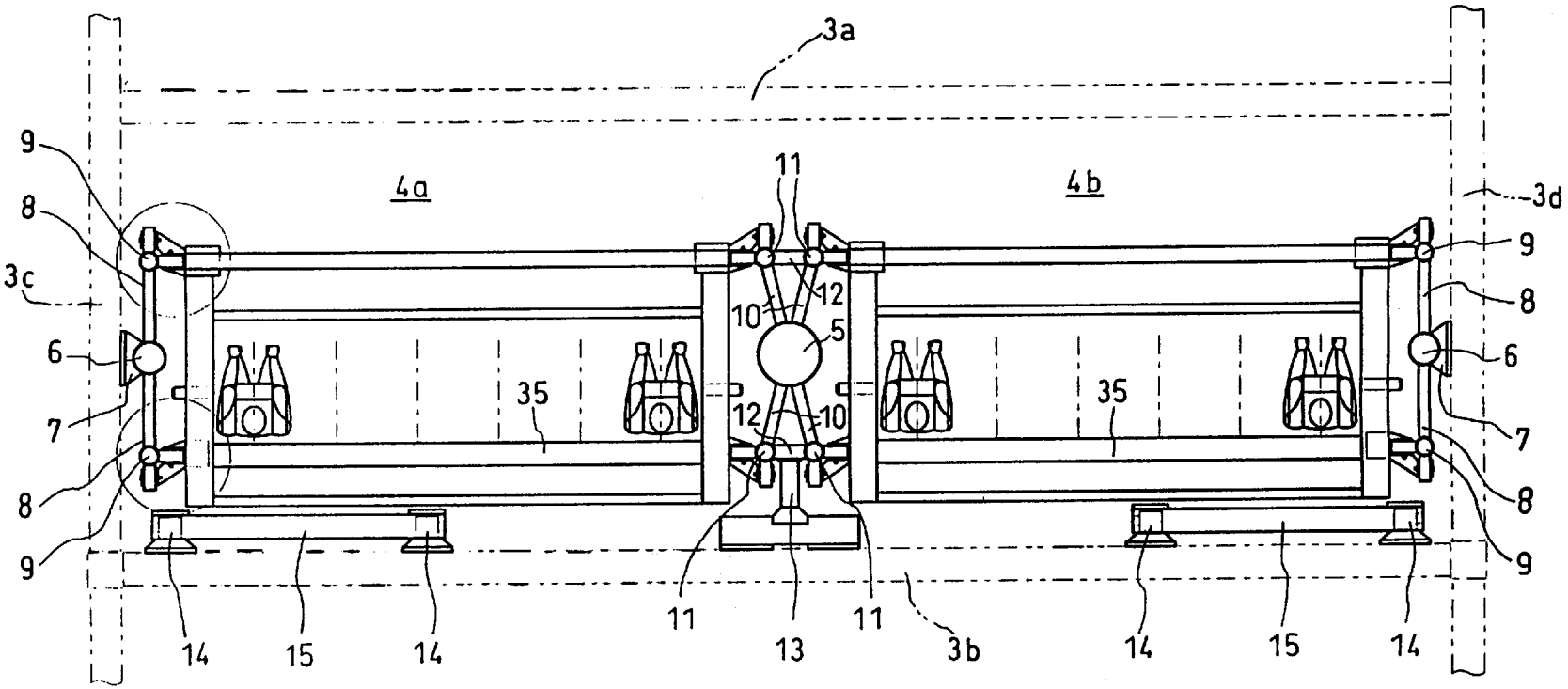
FIG. 4 is a horizontally-sectioned plane view of FIG. 1.

Embodiments of the invention will now be explained below with reference to FIGS. 1 through 14. As shown in FIGS. 2 and 3, the amusement ride system 0 is installed in a building 1 having one underground floor plus three above-ground floors. Second and third floors 2*b*, 2*c* are cut out over the area of installment of the amusement ride system 0 in the building 1 to form a vertically through space, and front, back, right and left vertical walls 3*a*, 3*b*, 3*c*, 3*d* are paneled to close the vertically through space. The "front and back" directions correspond to upper and lower directions in FIG. 4 that is a horizontally-sectioned plane view whereas the "right and left" directions correspond to right and left directions of FIG. 4. As shown in FIG. 4, a thick steel-pipe central pole 5 stands vertically at a position approximately central both in the front and back direction and in the right and left direction. Side poles 6 stand in parallel at right and left side positions in alignment with the center pole 5 in terms of the front and back direction. The side poles 6 has a plurality of horizontal rods 8 secured thereto to extend horizontally in predetermined intervals in the up and down direction, and guide rails. At distal ends of the horizontal rods 8, a vertically oriented guide rail 9 is immovably fixed. The closed space 4 is divided into a left closed space 4*a* and a right closed space 4*b* at opposite sides of the central pole 5.

Horizontal rods 10 are secured with their proximal ends to front and read surfaces of the central pole 5 along a horizontal plane to extend in form of V on the right and left sides, respectively. Vertically extending guide rails 11 are secured to proximal ends of the horizontal rods 10. The guide rails 11 are connected together in each of the right and left pairs of them by connection rods 12, and the rear connection rods 12 is secured to the rear wall 3*b* via a bracket 13.

Figure 1:
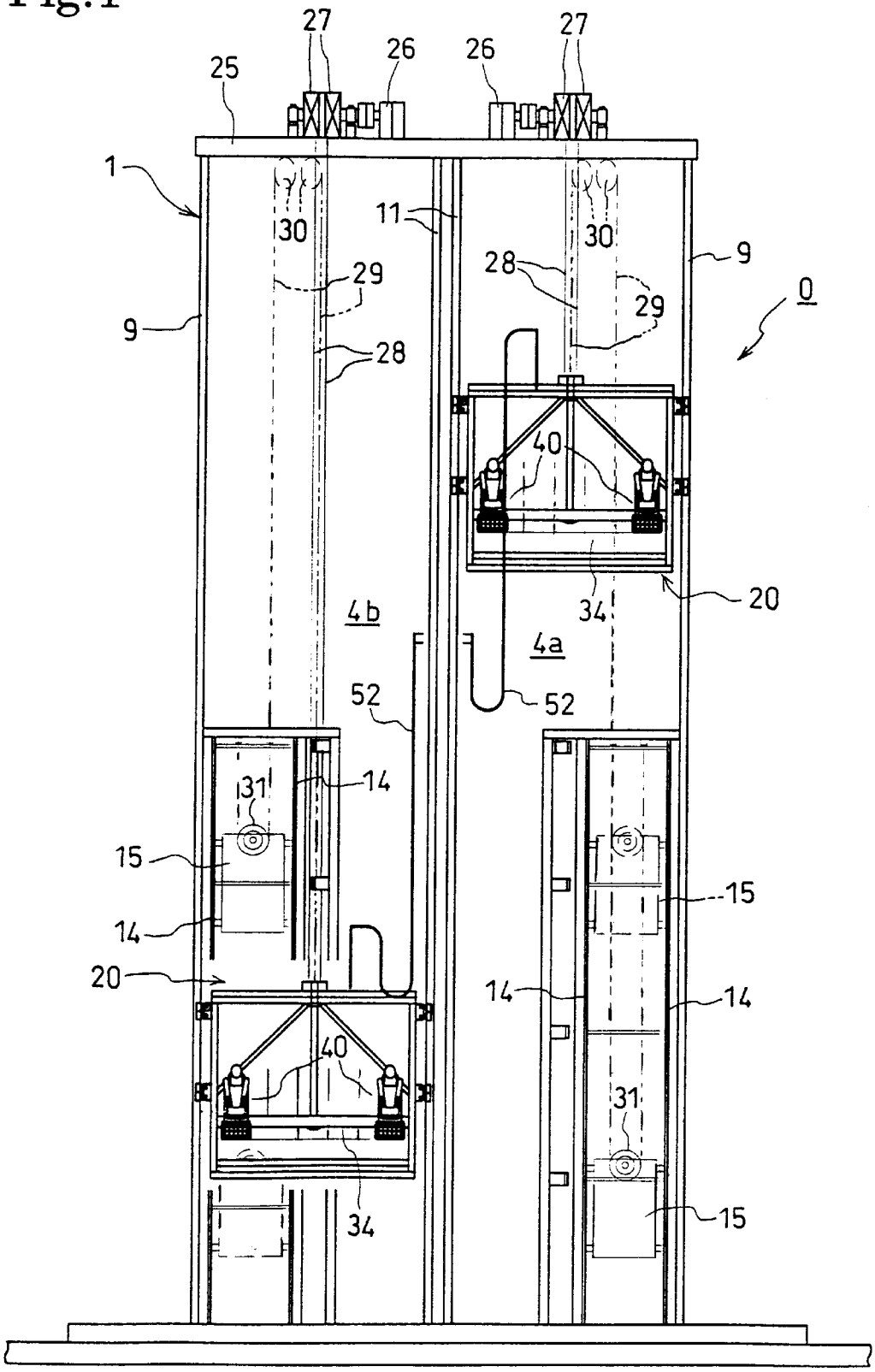
FIG. 1 is an entire, vertically-sectioned, front-elevational view that shows an embodiment of the amusement ride system according to the invention.

As shown in FIGS. 1 and 4, on each of right and left extensions of the rear wall 3*b*, a pair of parallel counterweight guide rails 14 are secured to extend perpendicularly, and a counterweight 15 is mounted to each counterweight guide rail 14 to move vertically.

As shown in FIGS. 2 and 3, in the left and right closed spaces 4*a*, 4*b*, screens 16, 17 are provided to lie on and along the inner surface of the front wall and the upper surface of the floor 2. A plurality of image projectors 18 for projecting an image on the screen 16 of the front wall 3*a* are arranged in constant intervals in the vertical direction along the inner surface of the rear wall 3*b*. An image projector 19 for projecting an image on the screen 17 on the floor 2 it provided at an upper position close to the inner surface of the front wall 3*a*.

Further provided are cages 20 movable vertically in the left and right closed spaces 4*a*, 4*b*, respectively. Each cage 20, when viewed from one side thereof as shown in FIG. 5, has a form of a turret made of steel frames, and a front lower portion there of is cut off and opened such that, as explained later, when seat support frames 34 and seats 40 bow aslant forward, the cage 20 does not enter in the field of vision of riders sitting on the seat support frames 34 and the seats 40.

Figure 6:
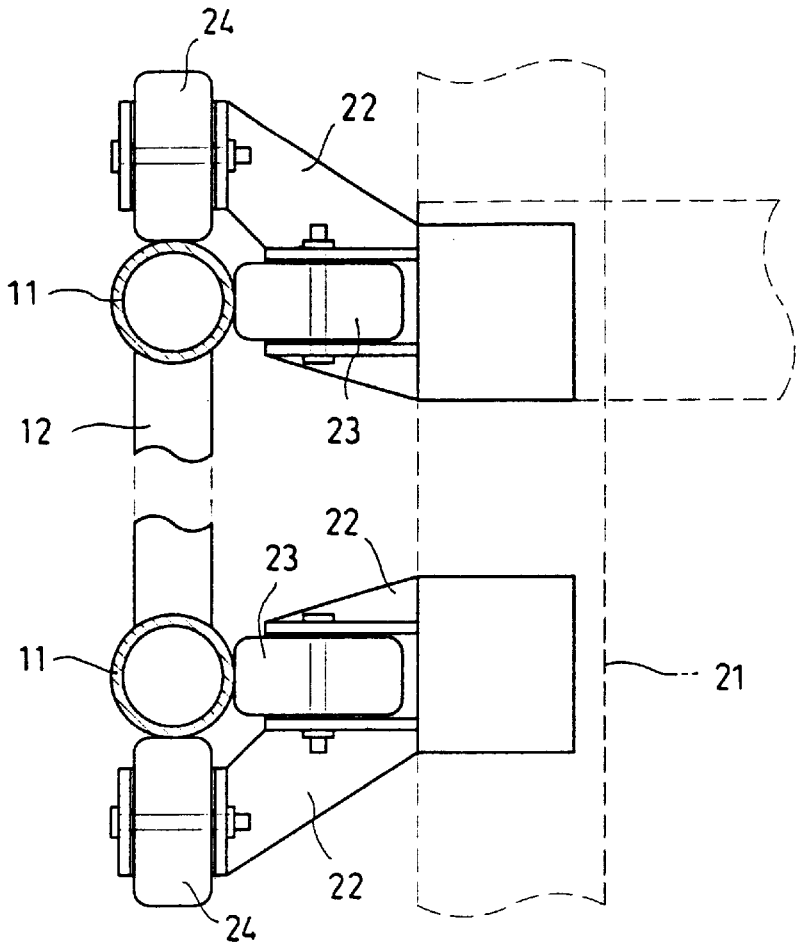
FIG. 6 is a fragmentary, enlarged, horizontally-sectioned plane view of FIG. 4.
Figure 7:
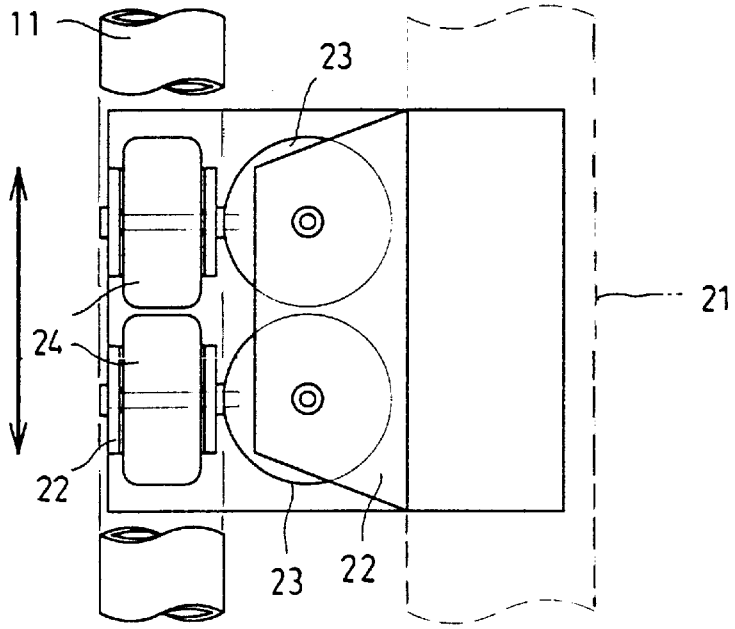
FIG. 7 is a side-elevational view of FIG. 6.

As shown in FIGS. 4, 6 and 7, four longitudinal rods 21 are provided in front, read, left and right portions of each the cage 20, and brackets 22, eight in total, are integrally affixed to upper and lower portions of each of these four longitudinal rods 21 to locate outside the cage 20. To each bracket 22, a guide roller 23 in contact with an inner surface of the guide rail 9 or 11 and a guide roller 24 in contact with an outer surface of the guide rail 9 or 11 are rotatably supported such that the cage 20 rides on the guide rollers 23, 24 and are stably guided by the guide rails 9 and 11 to move vertically.

As shown in FIG. 1, a top plate 25 lie on top ends of the central pole 5 and the side poles 6 to extend horizontally. The top plate 25 supports thereon two lift motors 26, one for the left closed space 4*a* and one for the right closed space 4*b*, to drive the cages vertically. Connected to the rotating shaft of each lift motor 26 are two wind-up drums 27 via a reducer, not shown. Two wind-up wires 28 are provided each having one end bound to a central position of a top surface of each cage 20 and the other end bound to the drum 27 after turns around the drum 27. Between these two wind-up wires 28, a counterweight wire 29 is provided with one end thereof bound to a central portion of the top surface of each cage 20. On the lower surface of the top plate 25, two stationary pulleys are pivotably supported for each closed space 4*a*, 4*b*, and a movable pulley 31 is pivotably attached to the top portion of each counterweight 15. Thus the counterweight wire 29 is wound on those two stationary pulley 30 and the movable pulley 31, and the other end of the counterweight wire 29 is bound to a horizontal rod 32 at the top of the counterweight guide rail 14, so that the cage 20 can move vertically in response to forward or reverse rotations of the lift motor 26 under appropriate balancing given by the counterweight 15.

Figure 5:
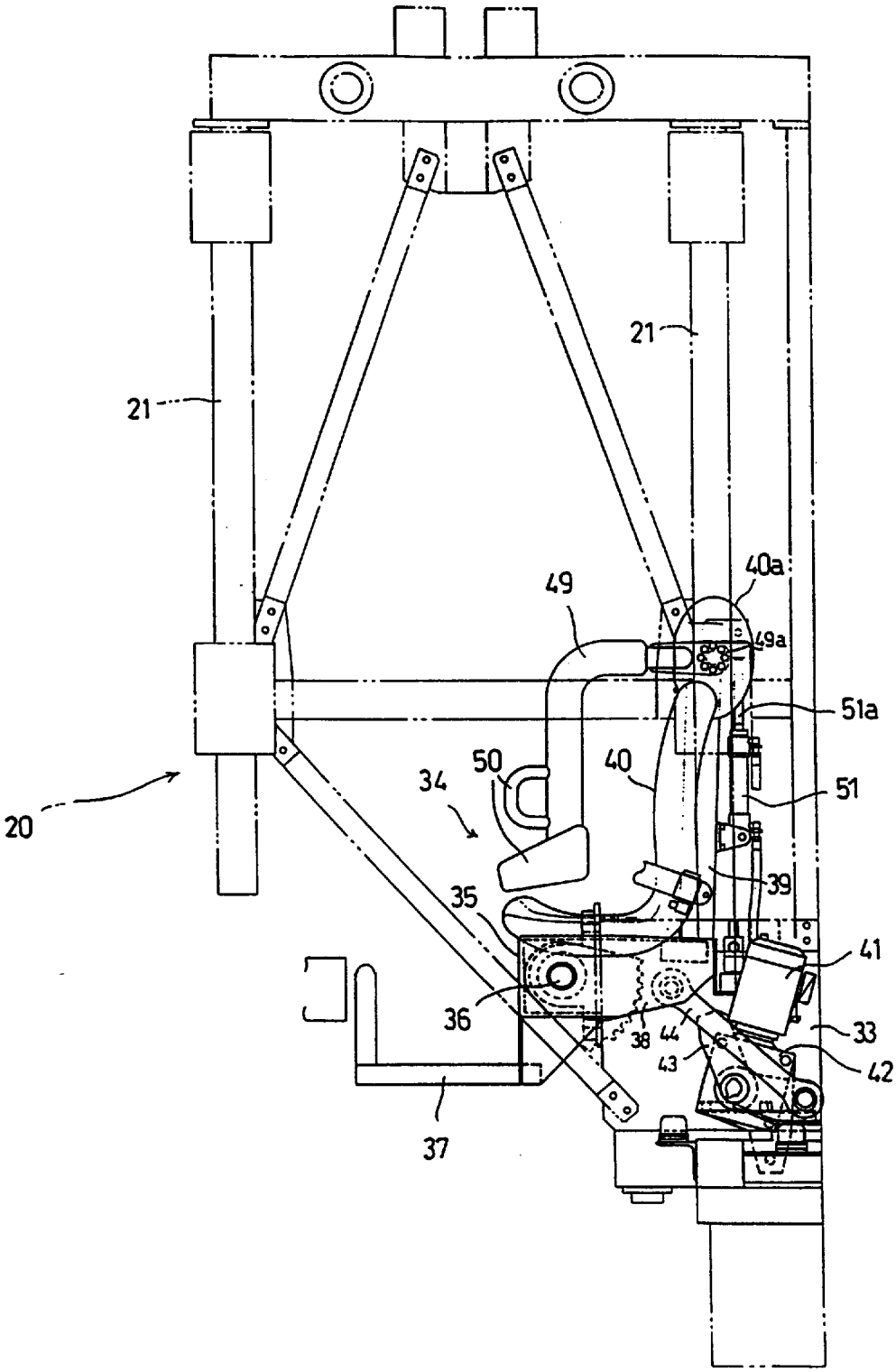
FIG. 5 is a fragmentary, enlarged, side-elevational view of FIG. 1.
Figure 8:
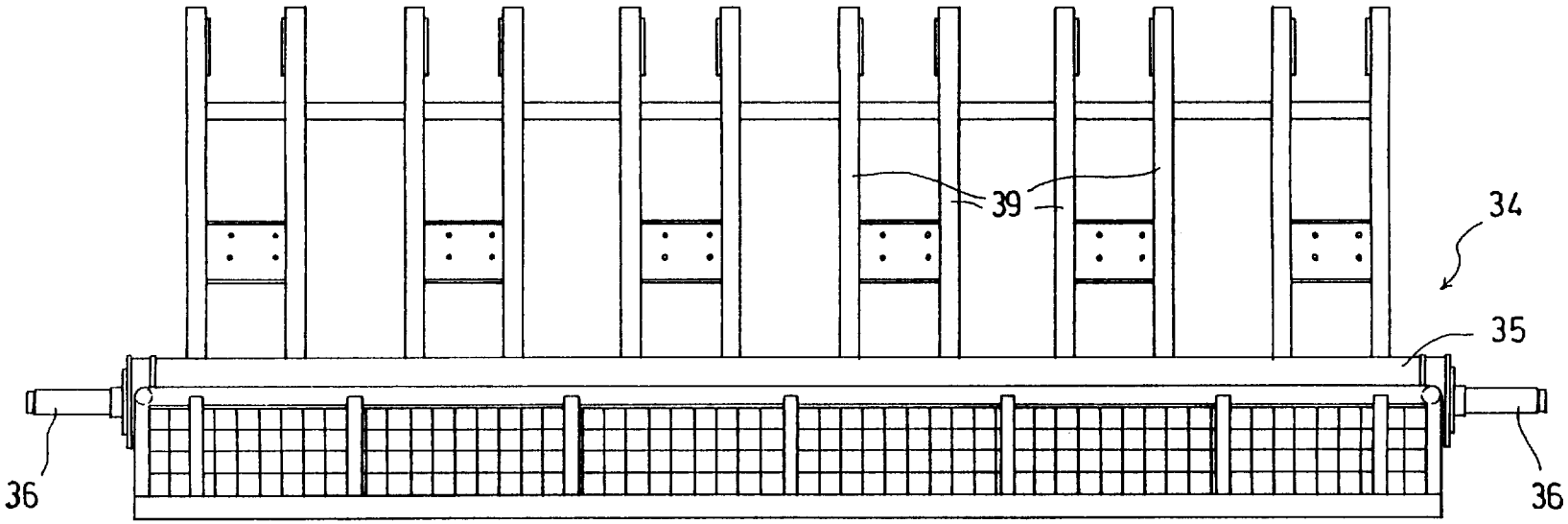
FIG. 8 is a front view of a seat support frame.
Figure 9:
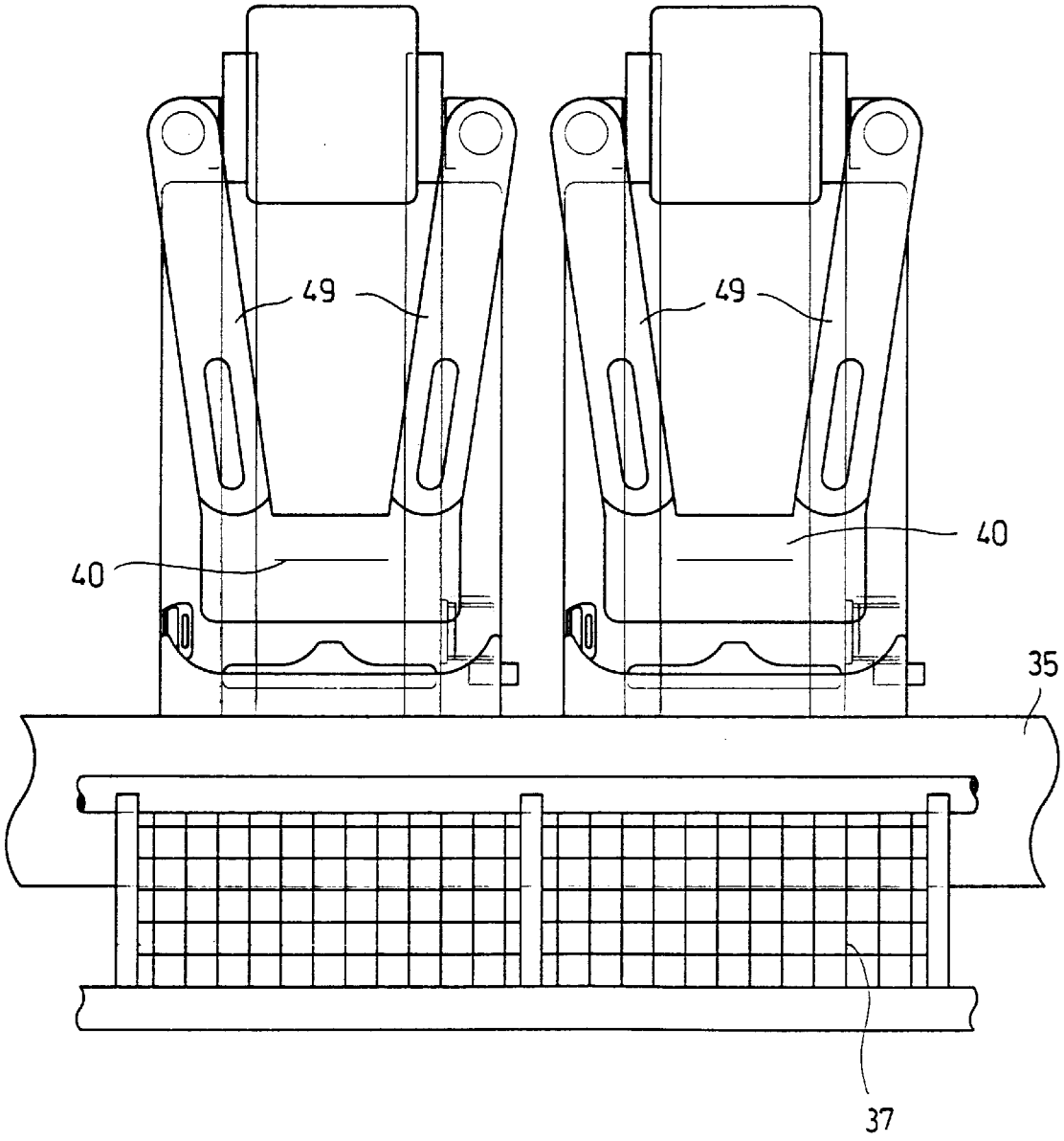
FIG. 9 is a fragmentary, enlarged, front-elevational view of the seat support frame and seats affixed thereto.
Figure 10:
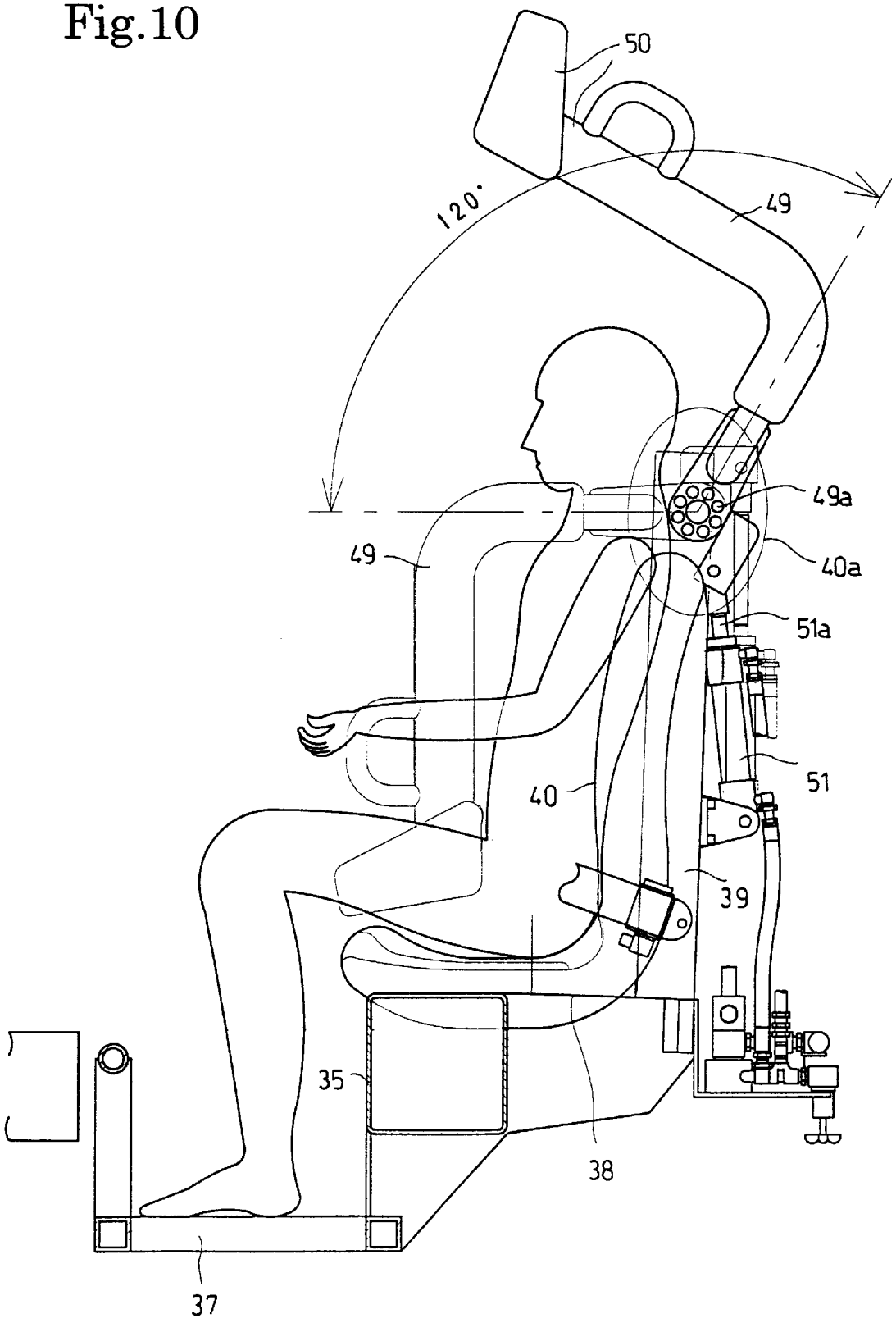
FIG. 10 is a side-elevational view of the seat support frame and a seat.

As shown in FIG. 5, seat support frame pivotal supports 33 are provided at right and left sides of a lower rear location of the cage 20, and as shown in FIG. 8, shafts 36 are integrally formed to project from right and left ends of a horizontal member 35 of the seat support frame 34, and these shafts 36 are received in bearing portions (not shown) of the seat support frame pivotal supports 33. The seat support frame 34 includes a foot rest 38 first extending down from the front face of the horizontal member 35, then extending forward, and finally extending upward at its distal end; a seat portion provided to extend rearward from the top surface of the horizontal member 35; and a back portion 39 extending upward from the rear end of the seating portion 38. As shown in FIG. 9, the seat portion and the back portion integrally support six seats (only two being in the illustration) 40 aligned in the left-and-right direction in predetermined intervals.

Figure 11:
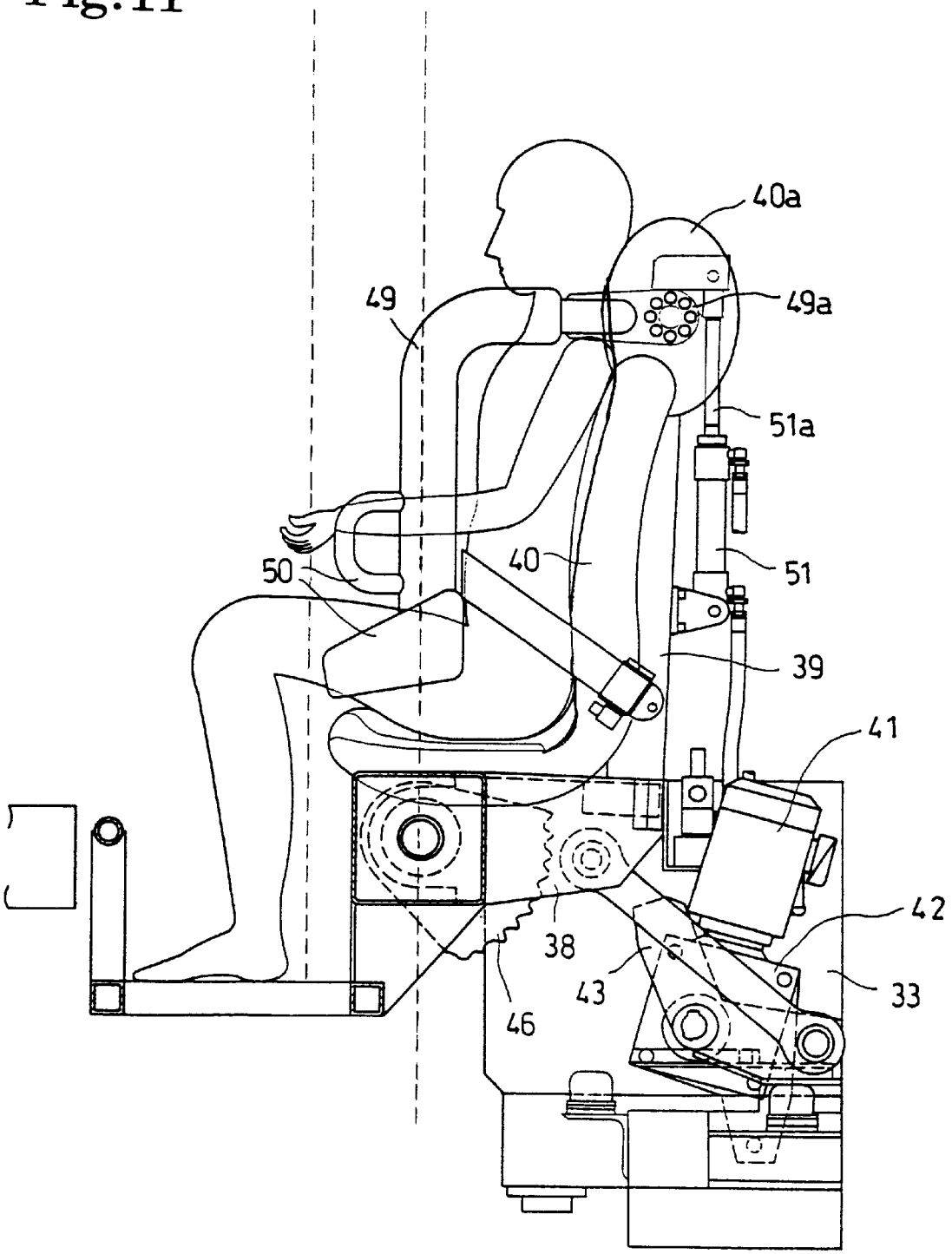
FIG. 11 is a side-elevational view that illustrates a mechanism for reclining the seat support frame and the seat.
Figure 12:
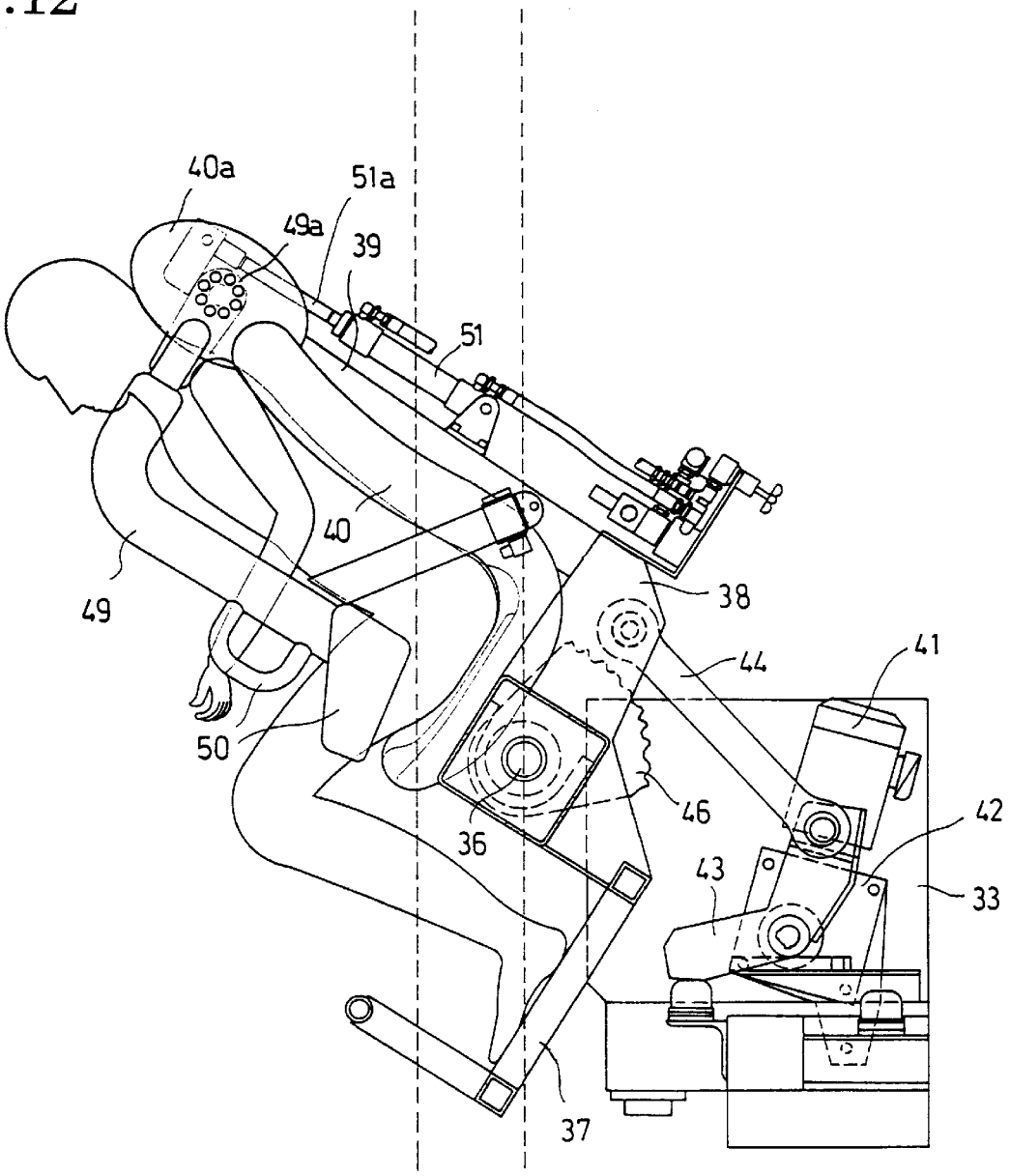
FIG. 12 is a side-elevational view corresponding to FIG. 11, with the seat support frame and the seat being inclined.

As shown in FIGS. 5, 11 and 12, bow drive motors 41 are mounted on right and left seat support frame pivotal supports 33. The rotating shaft of each bow drive motor 41 is connected to a swing lever 43 via a reducer 42, and the swing lever 43 and the seat portion 38 of the seat support frame 34 are connected for swinging movements via a connection rod 44. In the posture 8 shown in FIGS. 5 and 11 where the swing lever 43 is at the clockwise limit position, the seat support frame 34 and seats 40 are held upright. In the posture shown in FIG. 12 where the swing lever 43 swings to the counter clockwise limit position, the seat support frame 34 and seats 40 are changed to bow aslant forward so that, as shown in FIG. 2, lines of vision Y of riders on the seats 40 intersect with the center line X of the projected flux of light projected from one of the image projectors 18.

Figure 13:
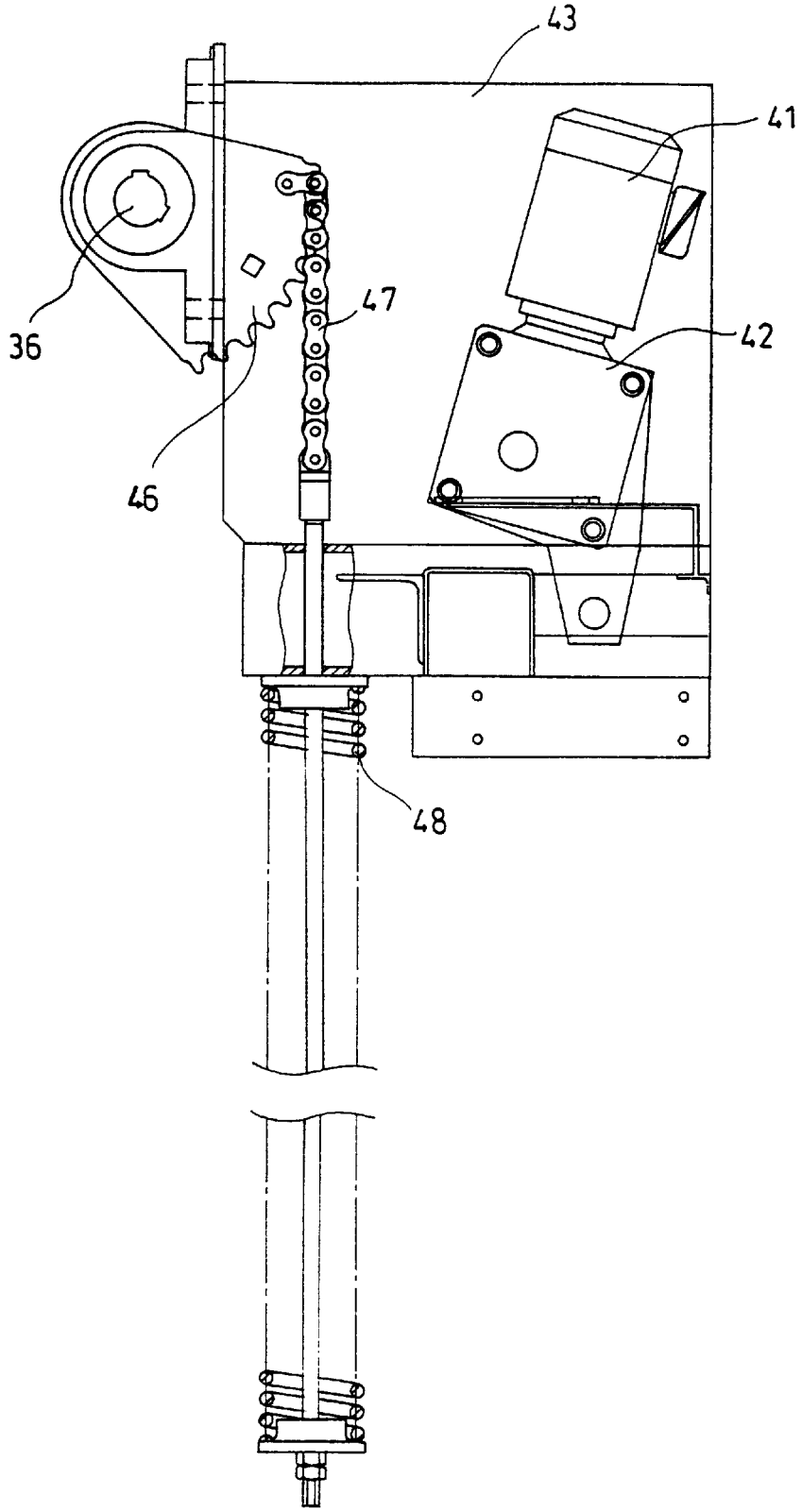
FIG. 13 is side-elevational view of an inclination moment removal device.
Figure 14:
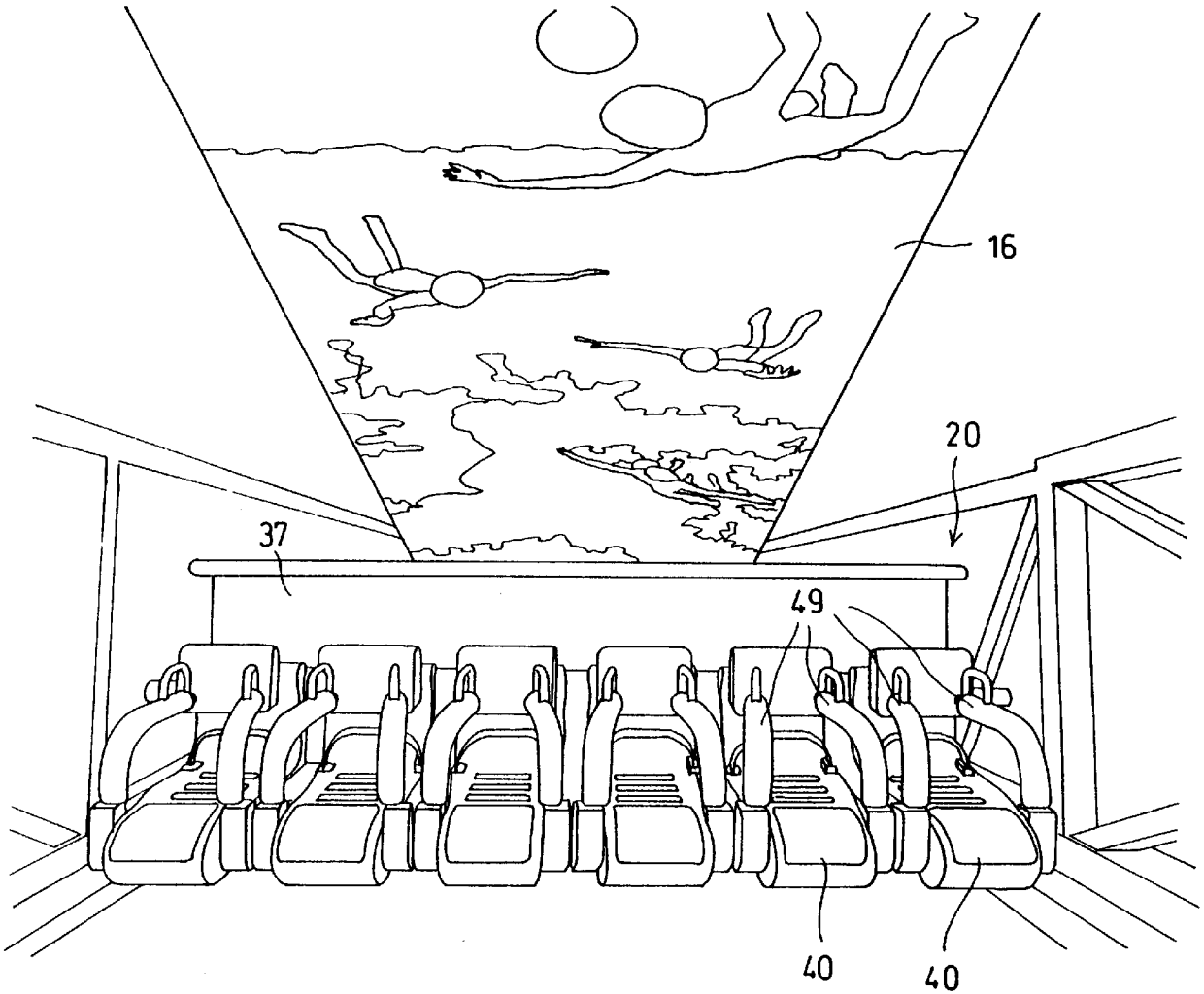
FIG. 14 is a perspective view of a screen and a gate taken from an upper position in a closed space of the amusement ride system.

Referring to FIG. 13, for the purpose of canceling the downward, forward slanting moment of the riders sitting on the seats 40 and the seat support frame 34 about the shafts 36, aslant moment canceling devices 45 are provided. Each aslant moment canceling device 45 is made up of a segment chain wheel 46 integrally fit on the shaft 36, a chain 47 bound with one end to the segment chain wheel 46 and wound on teeth of the segment chain wheel 46, and a tensile coil spring 48 biasing the chain 47 downward.

A embracing member 49 extends from the top portion (or headrest) 40*a* of each seat 40 to embrace the rider on the seat 40 by urging the rider's shoulders against the seat 40 and urging the body from right and left sides thereof. The proximal end 49*a* of the embracing member 49 is pivotably supported to permit the embracing member 49 to rotate in the range from the front position to the top position. A cushion member 50 covers the outer circumference of the embracing member 49, and the proximal end 49*a* of the embracing member 49 is connected to a piston rod 51*a* of a hydraulic cylinder 51. The cylinder chamber, not shown, of the hydraulic cylinder 51 is connected to an accumulator (not shown) via a hydraulic circuit interposing an electromagnetic cutoff valve so that, when the electromagnetic cutoff valve is opened, the embracing member 49 can be rotated freely, but when the electromagnetic cutoff valve is closed, the embracing member 49 is fixed in its condition for embracement.

Each cage 20 is connected to the exterior of the wall 3 by a cable 52 that supplies the power source to the room lighting equipment of the cage 20, the electromagnetic cutoff valve in the hydraulic circuit, and other electric parts.

An opposing wind machine, not shown, is provided behind or under the seats 40. The outlet of the opposing wind machine is connected to a duct (not shown) extending along the horizontal member 35. A nozzle, not shown, is provided to open upward from the footrest 37 for each seat 40. The nozzle includes a wind adjusting valve to close when the cage 20 is lifted up, and to open, depending on the descending speed of the cage 20 while it is driven downward, for the purpose of adjusting the strength of the wind hitting the body and the face of the rider.

The amusement rider system 0 also includes an automatic drive control device, not shown, such that an operator can manipulates it to start a predetermined sequence of successive operations including embracement by the embracing member 49, projection by the image projectors 18, 19, forward and reverse rotations of the lift motor 26, forward and reverse rotations of the bow motor 41, opening and closing of the wind adjusting valves, and so on.

Since the embodiment shown in FIGS. 1 through 14 has the configuration explained above, as shown in the left closed space 4*b* of FIG. 1 and in the closed space 4*a* of FIG. 3, when the cage 20 is moved down to the level of the ground floor 2*a*, the lock of the embracing member 49 is released, then the riders, having enjoyed the ride within the cage 20, can kick up the embracing member 49 and can exit the cage 20 onto the floor 2*a*. Then new riders enter the cage 20. When the new riders sit on the seats 40 and rotate the embracing member 49 downward, the riders will be able to be embraced.

Thereafter, when the operator of the amusement ride system 0 manipulates the drive start switch, the electromagnetic cutoff valve in the hydraulic circuit of the hydraulic cylinder 51 gets in the closed condition, and the embracing member 49 is fixed in its condition for embracement under which the riders cannot kick it up, ready for another travel of the cages 20.

The image projectors 18, 19 are then activated to project images of outdoor, aerial sceneries, and at the same time, the lift motor 26 begins forward rotation, which results in lifting the cage 20. When the cage 20 reaches the upper limit height, the lift motor 26 repeats forward and reverse rotations several times to drive the cage 20 up and down several times. In this period of time, the bow motor 41 rotates forward to rotate the seat support frame pivotal support 33 and the seats the shafts 36 about the shafts 36 to largely incline them forward as shown in FIG. 12. As a result, the seats 40 riders on the seats 40 can feel as if they swim in the air downward.

In this manner, while holding the riders in downward-oriented posture and thereby giving the riders a feeling of fear about the possibility of falling down, the screens 16 and 17 represent images of skydivers swimming in the air, air planes flying in the air, distant ground landscapes, and so on, which can give the riders a vivid imagination of sky swimming.

Moreover, since the strength of the wind blowing upward from the footrest 37 and hitting clothes and faces of the riders vary with the descending speed of the cage 20, the riders can feel as falling at a higher speed than the real descending speed of the cage 20.

Further, as shown in FIGS. 2 and 3, light beams projected from the image projectors 18 onto the screen 16 travel substantially horizontally, whereas the seat support frame pivotal support 33 and the seats 40 bow aslant forward, and lines of vision of the riders on the seats 40 also incline downward. Therefore, the riders on the seats 40 pass the front area of the uppermost image projector 18, and light beams from the uppermost image projector 18 are interrupted by the cage 20, seat support frame pivotal support 33, seats 40 and riders thereon, which makes shades of these objects on the screen 16. However, as shown in FIGS. 2 and 3, since the lines of the riders on the seats are directed downward to watch images on the screen projected from one of the second to fourth projections 18 as ordered from the top. Therefore, the riders will not watch the screen with those shades, and can always get vivid images of sky walking.

In addition, since the image projector 19 for projecting images on the screen 17 is located at an upper position inside the front wall 3*a* in the closed space 4, it can stably project images on the screen 17, absolutely freely from interference by the cage 20 vertically moving inside the closed space 4, seat support frame pivotal support 33, seats 40 and riders on the seat.

Furthermore, even when the seats 40 bow aslant, the riders on the seats 40 are safely prevented from falling down by the embracing members 49 that reliably held with their upper bodies in position.

The automatic drive control device explained above preferably controls the image projectors 18, 19 to project images such that objects in the images move in the direction opposite from that of the riders, thereby to give the riders more reality and excitation.

The embodiment shown in FIGS. 1 through 14 has been explained as orienting the direction of projection of the image projectors substantially horizontally and rotating the seats 40 to bow aslant forward; however, even if the image projectors 18 are located to above the upper limit of the moving range of the cages 20 while orienting the direction of the projection of the image projectors 18 obliquely downward and forward, and orienting the seats 40 approximately horizontally, beams of light are not interfered by the cage 20 that moves in the space between the screen 16 and the image projectors 18.

Figure 15:
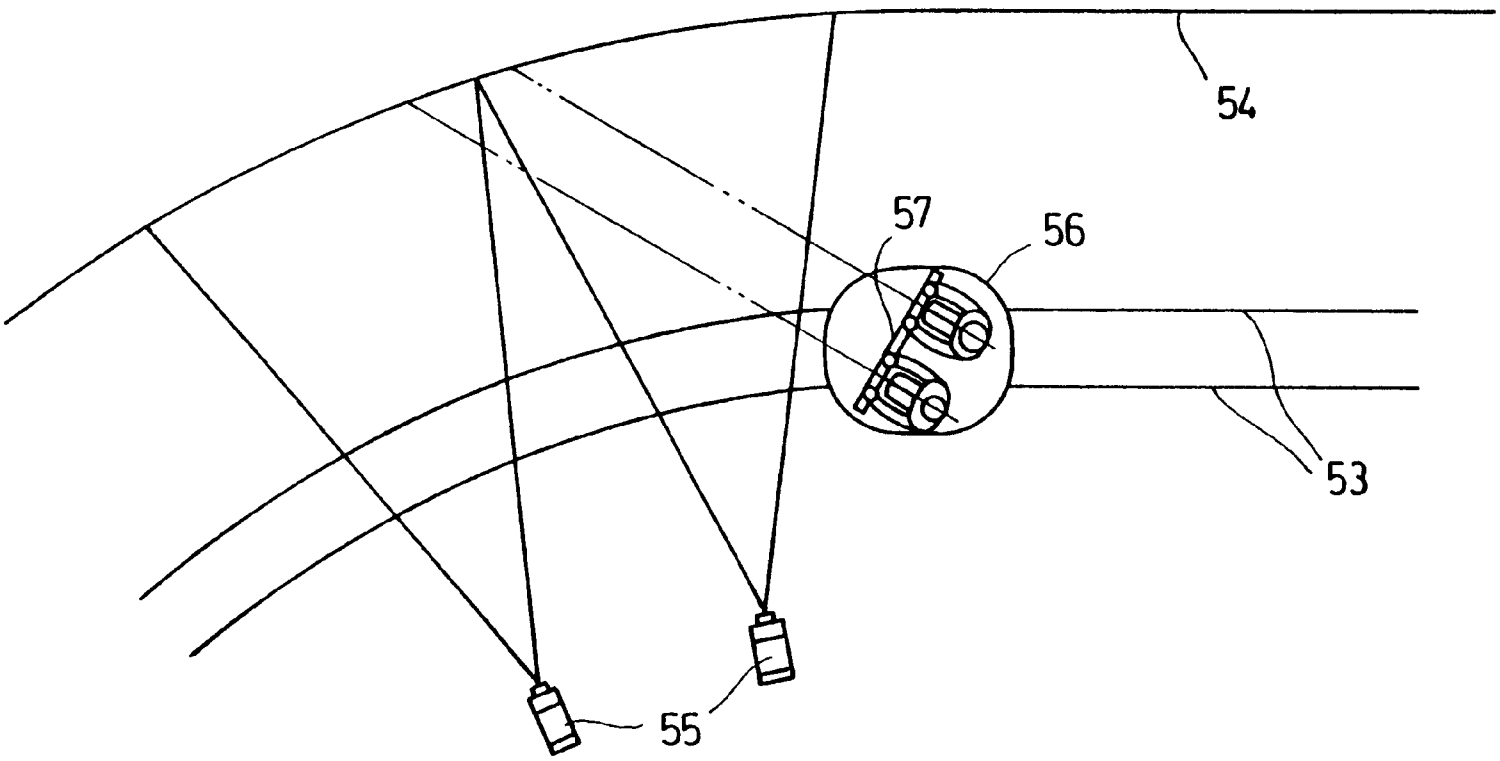
FIG. 15 is a plan view of another embodiment.

As shown in FIG. 15, it is also possible to place a screen 54 along a horizontal rail 53 provided on the floor; provide image projector 55 for projecting ground sceneries in predetermined intervals along the rail 53 on one side thereof remoter from the screen 54; providing seats 57 for riders to sit inside one or more carts 56 that can run on the rail 53; projecting images with the image projector 55 such that objects in the images move in the direction substantially perpendicular to the lengthwise direction of the rail 53; and orient the seats 57 toward the screen 54 (right in FIG. 5) relative to the running direction (arrow-marked) of the cart 56 by a predetermined angle (for example, 30 degrees). Also in this modified embodiment, since riders in the cart 56 will not observe on the screen 54 the images from the image projector 55 located just beside their cart 56, the riders on the cart 56 can only watch vivid images on the screen 54. The horizontal rail 53 may be planar, but instead, may be slightly slanted, or may have some vertical undulation to give up and down movements to riders during the travel of the cart 56.

Figure 16:
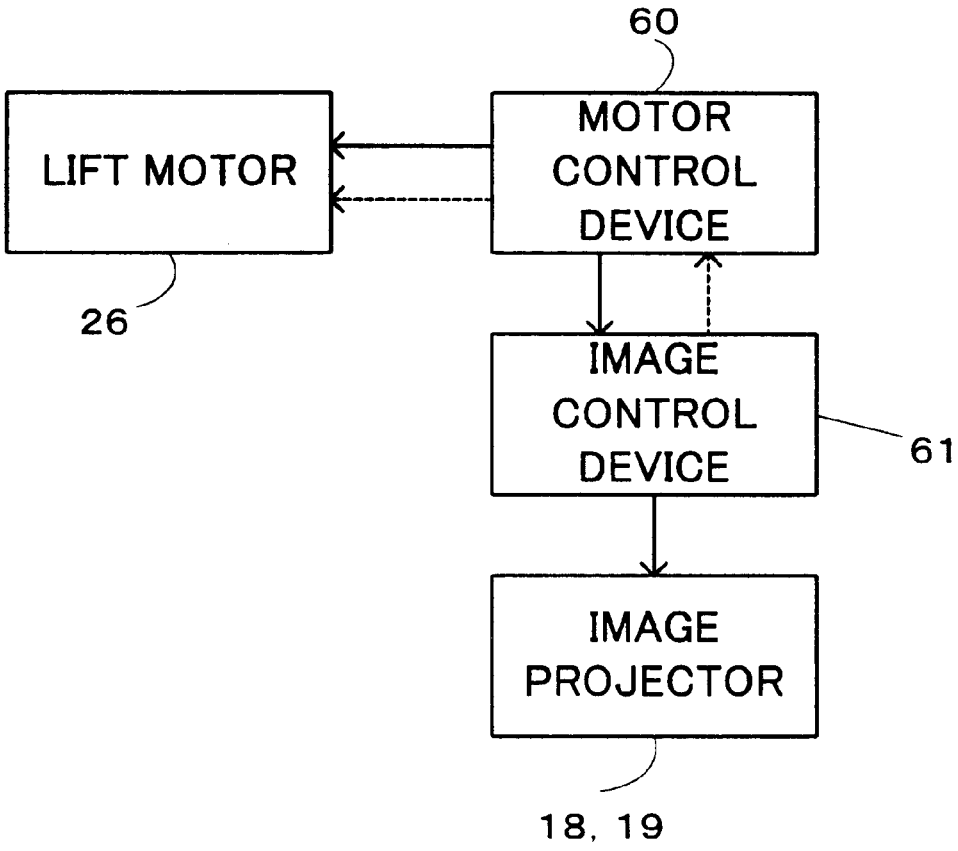
FIG. 16 is a block diagram that shows control devices of a vertically driving motor and an image projector.

Furthermore, it is alternatively possible to activate image display devices such as image projectors 18, 19 in response to the lift motor 26 used as a drive device for moving the seats 57 along the moving path. For this purpose, as shown in FIG. 16, a signal may be input from a motor control device 60 of the lift motor 26 to image display devices such as image projectors 18, 19 via an image control device 61. As a result, the image control device 61 will control images on the screens 16, 17 in synchronism with movements of the seats 57. In addition, as shown by the broken line in FIG. 16, activation of the lift motor 26 as a seat drive device for moving seats may be controlled in response to the status of representation of images on the screens 16, 17 controlled by the image controller 61.

What is claimed is:

1. An amusement ride system including a structure forming a traveling path, an amusement ride for a rider to ride, and a drive device for moving the amusement ride along said traveling path, comprising:

a fixed display screen provided on a first side of said traveling path to extend along said traveling path;

at least one image projector for projecting image signals toward said display screen, said at least one image projector being fixed on a second side of said traveling path, opposite from said first side, such that as the amusement ride moves along said traveling path the amusement ride crosses the image signals; and said amusement ride having a device that orients the line of vision of the rider on said amusement ride in a direction crossing the direction of said image signals from said at least one image projector, whereby the rider on the amusement ride sees only portions of the display screen on which the image signals are not obstructed by the moving amusement ride.

2. An amusement ride system according to claim 1 further comprising a floor, a floor display screen extending along said floor, and an image projector for projecting an image onto said floor display screen.

3. An amusement ride system according to claim 1 wherein said traveling path extends vertically, and said amusement ride is configured to orient the line of vision of said rider bowing aslant forward.

4. An amusement ride system according to claim 3 wherein a seat for a rider to sit on can bow aslant forward of the rider while said amusement ride travels up and down.

5. An amusement ride system according to claim 4 further comprising an embracing means for hold the rider on the seat sitting in position of said seat while said amusement ride travels up and down.

6. An amusement ride system according to claim 1 wherein said traveling path is substantially horizontal with or without vertical undulation, and said amusement ride is configured to orient the line of vision of the rider thereon toward a region of said display screen distant in the traveling direction from a region thereof normal to the current position of said amusement ride.

7. An amusement ride system according to claim 6 wherein said amusement ride has a seat for a rider to sit on, and said seat faces forwardly aslant from the traveling direction of said amusement ride.

8. An amusement ride system according to claim 1 wherein said amusement ride has a seat for a rider to sit on, and a blower means is provided to blow a wind from under said seat toward the rider sitting on the seat.

9. An amusement ride system according to claim 1 wherein said at least one image projector is series of image projectors.

10. An amusement ride system including an amusement ride for a rider to ride, and a drive device for moving the amusement ride along a traveling path, comprising:

a display screen provided to extend along said traveling path;

an image projector for projecting an image toward said display screen, said image projector extending along one side of said traveling path opposite from said display screen; wherein said amusement ride is adapted to orient the line of vision of the rider on said amusement ride in a direction transverse to an image projecting direction of said image projector; and a floor, a floor display screen extending along said floor, and an image projector for extending an image onto said floor display screen;

wherein said amusement ride is partly cut out to be opened over an area forward and downwardly aslant forward of said seat.

11. An amusement ride system including an amusement ride for a rider to ride, and a drive device for moving the amusement ride along a traveling path, comprising:

a display screen provided to extend along said traveling path; and an image projector for projecting an image toward said display screen, said image projector extending along one side of said traveling path opposite from said display screen, wherein said amusement ride is adapted to orient the line of vision of the rider on said amusement ride in a direction transverse to an image projecting direction of said image projector;

wherein said image projected on said display screen contains a moving object which moves in the opposite direction from the traveling direction of said amusement ride.

12. An amusement ride system having a seat for a rider to sit on, comprising:

an amusement ride being movable along a traveling path and having a seat thereon, said seat facing forwardly aslant of the traveling path;

a fixed display screen for representation of an image thereon, said display screen extending along said traveling path;

an image display device for displaying said image on said display screen, said image display device being fixedly provided in said traveling path;

a drive device for moving said seat relative to said display screen; and a means for controlling said image display device to display the image on said display screen in response to activation of said drive device.

13. An amusement ride system according to claim 12 wherein said image display device includes an image control device for controlling the image synchronously with the travel of said seat, and an image producing means for generating the image in response to a signal from said image control device.

14. An amusement ride system having a seat for a rider to sit on, comprising:

an amusement ride being movable along a traveling path and having a seat thereon, said seat facing forwardly aslant of the traveling path;

a fixed display screen for representation of an image thereon, said display screen extending along said traveling path;

an image display device for displaying said image on said display screen, said image display device being fixedly provided in said traveling path;

a seat drive device for moving said seat; and a drive control device for controlling said seat drive device in response to activation of said image display device such that said seat drive device moves said seat in response to a condition of representation of the image on said display screen by said image display device.

* * * * *